US006971287B2

(12) United States Patent
Lee et al.

(10) Patent No.: US 6,971,287 B2
(45) Date of Patent: Dec. 6, 2005

(54) REVERSIBLE RATCHETING TOOL WITH IMPROVED CONTROL MEMBER

(75) Inventors: Pei Y. Lee, Garland, TX (US); Tzu S. Shzu, Garland, TX (US); Robert L. Arnold, Wrightsville, PA (US)

(73) Assignee: Easco Hand Tools, Inc., Simsbury, CT (US)

( * ) Notice: Subject to any disclaimer, the term of this patent is extended or adjusted under 35 U.S.C. 154(b) by 0 days.

(21) Appl. No.: 11/038,651

(22) Filed: Jan. 19, 2005

(65) Prior Publication Data

US 2005/0155464 A1 Jul. 21, 2005

Related U.S. Application Data

(62) Division of application No. 10/752,138, filed on Jan. 6, 2004.

(51) Int. Cl.[7] ..... B25B 13/46
(52) U.S. Cl. ..... 81/63.2; 81/60
(58) Field of Search ..... 81/60–63.2

(56) References Cited

U.S. PATENT DOCUMENTS

| | | | | |
|---|---|---|---|---|
| 893,097 | A | 7/1908 | Reams | |
| 1,440,272 | A | 12/1922 | Bratton | |
| 1,826,765 | A | 10/1931 | Gang | |
| 1,854,513 | A | 4/1932 | Hummel | |
| 1,957,462 | A | 5/1934 | Kress | 81/63 |
| 2,107,568 | A | 2/1938 | Haist | 81/62 |
| 2,137,331 | A | 11/1938 | Ward | 192/43.1 |
| 2,138,332 | A | 11/1938 | Geisel | 192/43.1 |
| 2,188,846 | A * | 1/1940 | Rueb | 192/43.1 |
| 2,957,377 | A | 10/1960 | Hare | 81/63.2 |
| 2,978,081 | A | 4/1961 | Lundin | 192/43.1 |
| 3,269,496 | A | 8/1966 | Kilness | 192/43.2 |
| 3,866,492 | A | 2/1975 | Knoll | 81/52.4 |
| 4,257,507 | A | 3/1981 | Solomon | 192/43.1 |
| 4,807,500 | A | 2/1989 | Main | 81/63.1 |
| 4,811,636 | A * | 3/1989 | Okura | 81/63.2 |
| 5,157,994 | A | 10/1992 | Krivec | 81/63.2 |
| 5,197,358 | A | 3/1993 | Hsu | 81/60 |
| 5,404,773 | A | 4/1995 | Norville | 81/63.1 |
| 5,467,672 | A | 11/1995 | Ashby | 81/58.2 |
| 5,957,009 | A | 9/1999 | McCann | 81/63.2 |
| 5,979,274 | A | 11/1999 | Hsieh | 81/60 |
| 6,109,141 | A * | 8/2000 | Nurmi | 81/63 |
| 6,161,454 | A * | 12/2000 | Chaconas | 81/63.2 |
| 6,209,422 | B1 * | 4/2001 | Kamiya et al. | 81/57.39 |
| 6,216,563 | B1 | 4/2001 | Hsieh | 81/63.2 |
| 6,230,591 | B1 | 5/2001 | Ling et al. | 81/63 |

(Continued)

*Primary Examiner*—David B. Thomas
(74) *Attorney, Agent, or Firm*—Nelson Mullins Riley & Scarborough, L.L.P.

(57) ABSTRACT

A ratcheting tool includes a body and a gear disposed in the body. The gear defines a plurality of teeth on a circumference of the gear. A pawl is disposed in the body so that the pawl is movable with respect to the gear between a first position, in which the body transmits torque through the pawl in a first rotational direction, and a second position, in which the body transmits torque through the pawl in an opposite rotational direction. The pawl defines a plurality of teeth facing the gear and engages a reversing lever that urges the pawl between the first and second positions. The reversing lever comprises a handle portion and bottom portion that receives a clip spring. The detent urges the pawl between the first and second position by engaging the walls of a recess in the back of the pawl.

4 Claims, 15 Drawing Sheets

U.S. PATENT DOCUMENTS

| | | | | |
|---|---|---|---|---|
| 6,253,647 | B1 * | 7/2001 | Eggert et al. | 81/63 |
| 6,260,449 | B1 * | 7/2001 | I-He | 81/63.2 |
| 6,282,992 | B1 * | 9/2001 | Hu | 81/63.2 |
| 6,289,771 | B1 | 9/2001 | Hsieh | 81/63 |
| 6,516,690 | B2 * | 2/2003 | Chen | 81/63 |
| 6,575,060 | B1 | 6/2003 | Tseng et al. | 81/63.2 |
| 6,647,833 | B1 | 11/2003 | Wu | 81/63.2 |
| 6,708,586 | B1 * | 3/2004 | Chen | 81/63.2 |
| 6,711,973 | B2 * | 3/2004 | Arnold et al. | 81/63.2 |
| 6,722,234 | B2 * | 4/2004 | Hu | 81/63.2 |
| 6,789,449 | B2 * | 9/2004 | Liu | 81/63.2 |
| 6,805,027 | B2 * | 10/2004 | Hsien | 81/63.2 |
| 6,805,028 | B1 * | 10/2004 | Chang | 81/63.2 |
| 2003/0070512 | A1 | 4/2003 | Hu | |
| 2004/0083860 | A1 | 5/2004 | Arnold et al. | 81/83.2 |

* cited by examiner

REVERSIBLE RATCHETING TOOL WITH IMPROVED CONTROL MEMBER

The present application is a divisional patent application of U.S. patent application Ser. No. 10/752,138, filed Jan. 6, 2004, the entire disclosure of which is hereby being incorporated by reference in its entirety.

BACKGROUND OF THE INVENTION

Ratcheting tools, for example ratchets and wrenches, often include a circular ratchet gear and a pawl that controls the gear's ratcheting direction so that the gear may rotate in one direction but is prevented from rotation in the other. It is known to dispose the pawl so that it engages teeth either on the gear's inner or outer diameter. Examples of ratcheting tools having a sliding pawl engaging the outer diameter of a ratchet gear are provided in U.S. Pat. Nos. 6,230,591 and 5,636,557, the entire disclosure of each of which is incorporated by reference herein.

SUMMARY OF THE INVENTION

The present invention recognizes and addresses considerations of prior art constructions and methods.

In one embodiment of a ratcheting tool according to the present invention, a ratcheting tool includes a body; a gear rotatably disposed in the body and defining a first plurality of teeth about an outer circumference thereof; a pawl disposed in the body and a detent. The pawl has a front side that faces the first plurality of gear teeth and has a second plurality of teeth and a back side facing away from said gear, wherein the pawl is movable between a first position in which the body imparts rotation to the gear in a first direction and a second position in which the body imparts rotation to the gear in a second direction opposite the first direction. The detent is disposed in the body and in operative engagement with the pawl back side so that the detent biases the pawl into the first and second positions. The detent includes a front wall, a back wall, and a spring base connecting said front wall and said back wall, wherein said base biases said front wall away from said back wall and toward said pawl back side.

In another embodiment, a ratcheting tool includes a body; a gear rotatably disposed in the body and defining a first plurality of teeth about an outer circumference thereof; a pawl disposed in the body and a detent. The pawl has a front side that faces the first plurality of gear teeth and has a second plurality of teeth and a back side facing away from said gear, wherein the pawl is movable between a first position in which the body imparts rotation to the gear in a first direction and a second position in which the body imparts rotation to the gear in a second direction opposite the first direction. The detent is disposed in the body and in operative engagement with the pawl back side so that the detent biases the pawl into the first and second positions. The detent includes a first sidewall, a second sidewall opposing said first side wall, and a spring front wall intermediate and connecting said first and said second side walls, wherein said front wall biases said first and said second side sidewalls toward each other.

In yet another embodiment, a ratcheting tool includes a body; a gear rotatably disposed in the body and defining a first plurality of teeth about an outer circumference thereof; a pawl disposed in the body and a detent. The pawl has a front side that faces the first plurality of gear teeth and has a second plurality of teeth and a back side facing away from said gear, wherein the pawl is movable between a first position in which the body imparts rotation to the gear in a first direction and a second position in which the body imparts rotation to the gear in a second direction opposite the first direction. The detent is disposed in a blind bore formed in one of the body and the lever and in operative engagement with the pawl. The detent includes a tightly wound spring portion forming a pin and an integrally formed loosely wound spring portion that biases the tightly wound spring portion out of the blind bore and toward the back side of the pawl.

In yet another embodiment, a ratcheting tool includes a body; a gear rotatably disposed in the body and defining a first plurality of teeth about an outer circumference thereof; a pawl disposed in the body and a detent. The pawl has a front side that faces the first plurality of gear teeth and has a second plurality of teeth and a back side facing away from said gear, wherein the pawl is movable between a first position in which the body imparts rotation to the gear in a first direction and a second position in which the body imparts rotation to the gear in a second direction opposite the first direction. The detent is disposed in a blind bore formed in one of the body and the lever and in operative engagement with the pawl. The detent includes a housing, a plunger received in said housing and a spring that biases the plunger toward the pawl backside.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
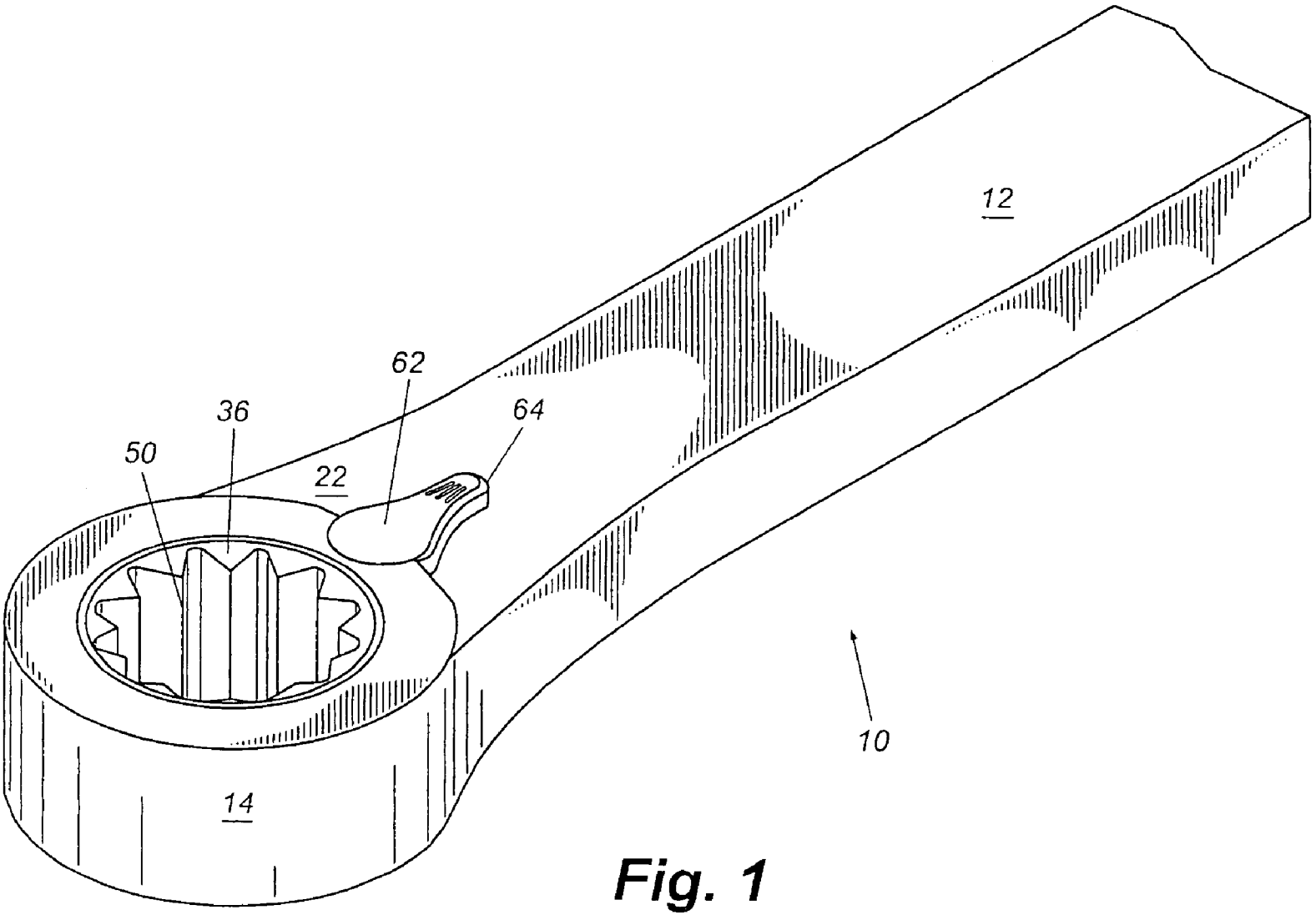
FIG. 1 is a partial perspective view of a ratcheting tool in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring to FIGS. 1 to 5, and in particular to FIG. 1, a ratcheting tool 10 includes a body with a handle 12 and a head 14 extending from the handle. The head and handle may be integrally formed from a material capable of withstanding high shear forces, for example stainless steel and metal alloys, ceramics, or plastics. Handle 12 may be a solid piece and is generally rectangular in shape. The shape and length of handle 12 may vary depending on the application of ratcheting tool 10; for example, handle 12 may be generally cylindrical or polygonal.

Figure 2:
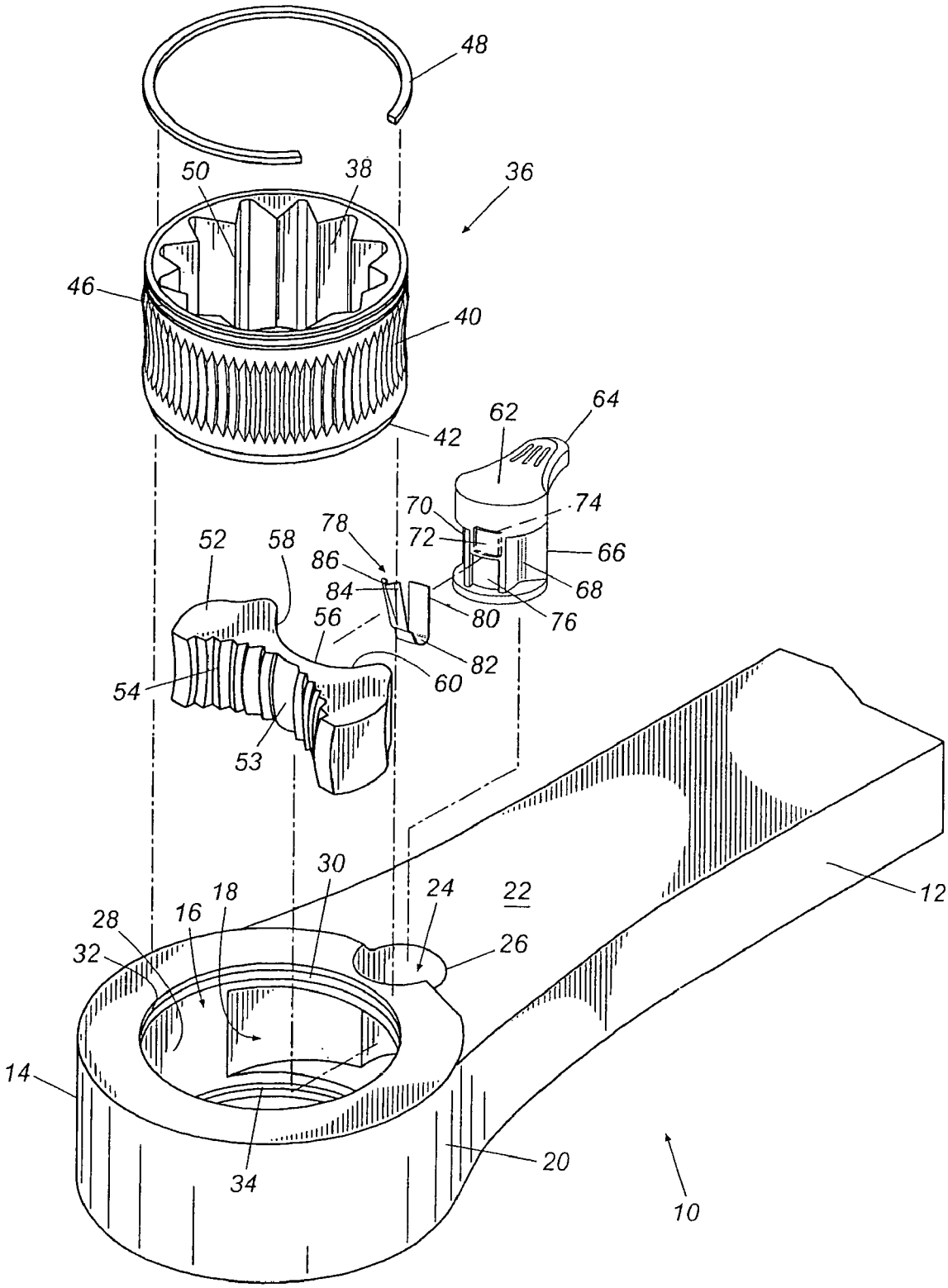
FIG. 2 is an exploded view of the ratcheting tool as in FIG. 1.
Figure 3:
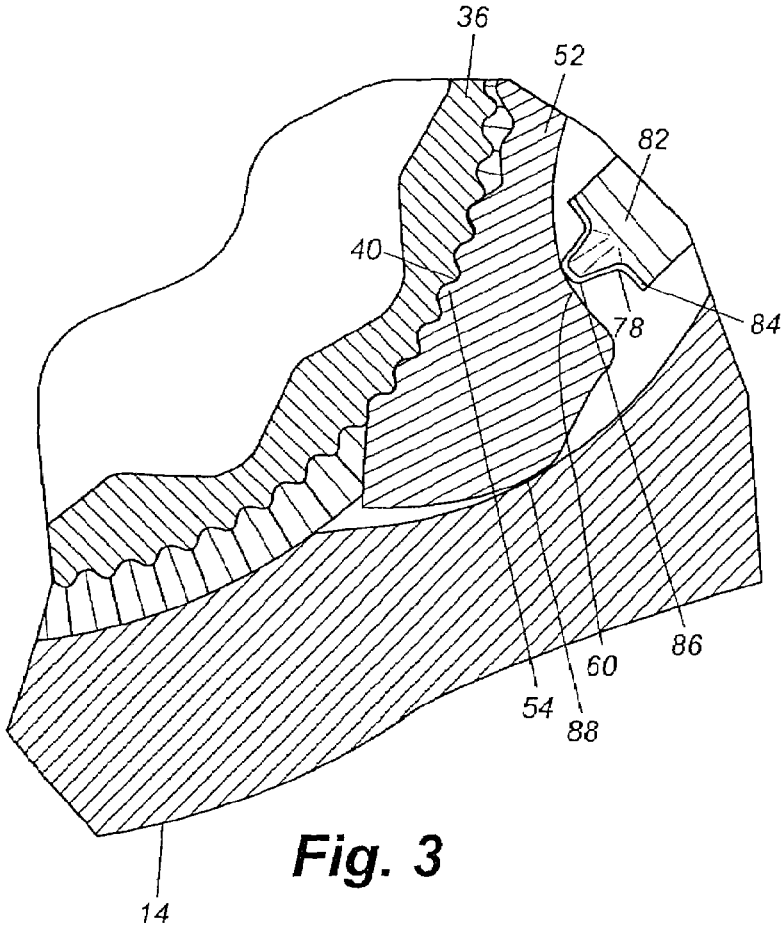
FIG. 3 is a partial top view, in section, of the ratcheting tool as in FIG. 1.

With reference to FIG. 2, head 14 defines a relatively large and generally cylindrical through-hole compartment 16. A smaller, wedge-shaped compartment 18 is defined in a web portion 20 intermediate head 14 and handle 12. A generally cylindrical compartment 24 extends through face 22 into web 20 at a hole 26 and is in communication with compartment 18. Compartment 18 is closed above and below and is in communication with compartments 16 and 24. Compartments 16 and 24 are cylindrical in shape, and compartment 18 is generally wedge shaped with curved side walls. A wall 28 defining compartment 16 defines an annular groove 30 proximate its top edge 32 and a flat annular inward extending ledge 34 proximate its bottom edge.

Figure 4:
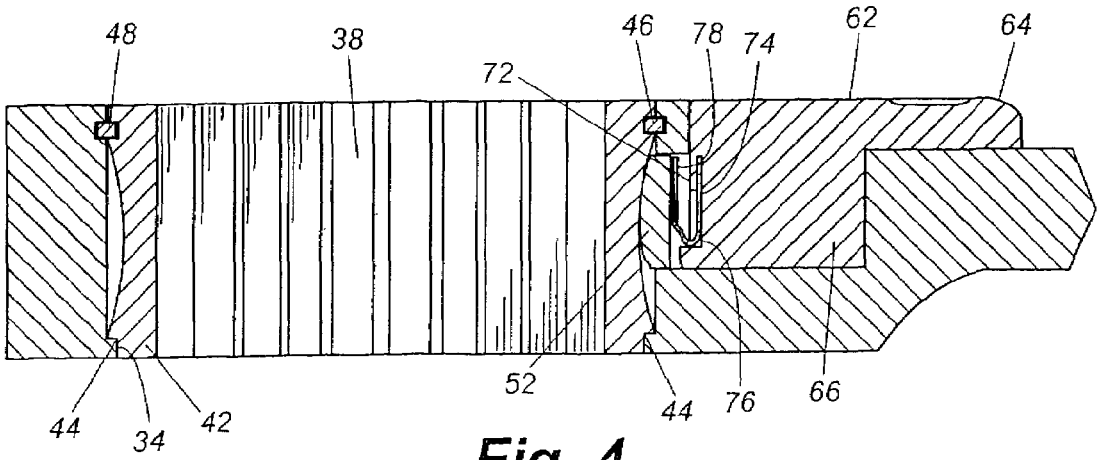
FIG. 4 is a side elevation view, in section, of the head of the ratcheting tool as in FIG. 1.

Compartment 16 receives an annular gear ring 36 having an inner surface 38 that is concentric with wall 28. Inner surface 38 of gear ring 36 defines a plurality of aligned keys 50 spaced equiangularly about inner surface 38. Keys 50 extend radially into compartment 16 and are spaced to engage the sides of a bolt, nut, or other work piece. The outer circumference of gear ring 36 defines a series of vertically-aligned teeth 40. Teeth 40 curve inward at their center so that the gear ring's outer surface defines a concave shape. A bottom side of gear ring 36 defines an extension portion 42 surrounded by a flat annular shoulder 44 (FIG. 4). Extension portion 42 fits through ledge 34 so that shoulder 44 sits on ledge 34, thereby retaining gear ring 36 in the lower axial direction. Extension portion 42 fits through ledge 34 with sufficient clearance so that the ledge secures the gear ring in the radial direction yet permits the gear ring to rotate with respect to head 14.

Gear ring 36 defines an annular groove 46 about its outer surface proximate its upper end. A C-ring 48 is received in groove 46, and an outer surface of the ring normally extends slightly outward of the groove. As gear ring 36 is inserted into compartment 16, C-ring 48 compresses into groove 46 until groove 46 aligns with annular groove 30 in the upper edge of wall 28. C-ring 48 then expands into groove 30, thereby securing gear ring 36 in the upper axial direction.

Figure 5A:
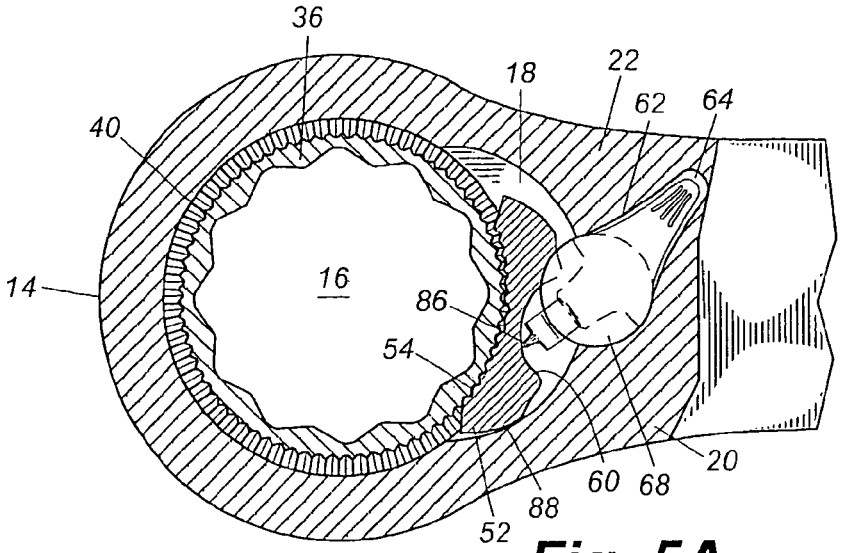
FIG. 5A is a partially cut-away top view of the ratcheting tool as in FIG. 1.

A generally wedge-shaped pawl 52 is received in compartment 18 so that the top and bottom surfaces of compartment 18 retain the pawl from above and below. Sufficient clearance is provided between those surfaces and the pawl, however, so that the pawl may easily slide from side to side. Pawl 52 defines a plurality of vertically-aligned teeth 54 in an arc across the pawl's front face that matches the arc of the outer perimeter of gear ring 36. In the vertical direction, teeth 54 curve outward in a convex shape that corresponds to the concave outer surface of gear ring 36. When the pawl engages the gear ring, as shown in FIGS. 5A and 5C, only half of teeth 54 engage opposing teeth 40 on the gear ring. The back end of pawl 52 defines a recessed portion 56. Recessed portion 56 defines an arc having symmetrical sides 58 and 60.

A switch lever 62 includes a handle portion 64 and a bottom portion 66 that extends below the handle portion. Two recessed portions 68 and 70 surround an arcuate front face 72. Referring to FIGS. 2 and 4, front face 72 defines a recessed channel 76 that terminates in a blind bore 74. Recessed channel 76 and blind bore 74 are sized and shaped to receive a detent 78.

Detent 78 (FIG. 2) is a generally U-shaped spring with a rectangular back wall 80, an arcuate bottom 82 and a rectangular front wall 84 having an outwardly projecting nose 86. The spring may be formed from any suitable resilient material, in one embodiment stainless steel, so that the front and back walls are biased away from each other. That is, arcuate bottom 82 is formed so that it biases front wall 84 away from back wall 80 yet allows the front wall to move against the bias toward the back wall. Referring particularly to FIG. 4, rectangular back 80 is slidably inserted into recessed channel 76 of switch lever 62 and into blind bore 74 so that spring bottom 82 rests on the bottom wall of recessed channel 76. In this position, detent 78 is locked in lever 62, and front face 84 projects upward and away from the lever's front face 72.

As shown in FIG. 2, hole 26 defined in top surface 22 receives bottom portion 66 of lever 62. The outer diameter of bottom portion 66 is approximately equal to the inner diameter of hole 26, although sufficient clearance is provided so that switch lever 62 rotates easily in the hole. In the embodiment shown in FIGS. 1–5, detent 78 retains lever 62 in compartment 24. That is, the top end of the spring engages the underside of compartment 18 while the spring's back end is locked into the lever, thereby preventing lever 62 from moving axially upward out of compartment 24. However, lever 62 may be secured in wrench 10 in various other ways. For example, the outer surface of bottom portion 66 may define an annular groove (not shown) that receives an O-ring (not shown). Upon insertion of bottom portion 66 into hole 26, the O-ring is initially pushed radially inward into the groove. When the groove aligns with an annular groove (not shown) defined about the inner circumference of hole 26, an outer portion of the O-ring extends into the groove, thereby axially securing switch lever 62 in web 20. A C-clip (not shown) may also be used in place of the O-ring in securing lever 62 in compartment 24. Other methods for securing lever 62 should be understood to be within the scope of the present invention.

In operation, pawl 52 may slide to either side of compartment 18. In the position shown in FIG. 5A, lever 62 is rotated counterclockwise to wedge pawl 52 between gear ring 36 and bottom side 88 of compartment 18. Outwardly biased nose 86 of spring 78 engages side 60 of pawl 52 so that as the lever rotates, the nose pushes the pawl to a position at which teeth 54 on the front face of pawl 52 align with and engage gear teeth 40. The pawl end proximate wall 88 abuts the wall so that the pawl wedges between the wall and the gear. Thus, if torque is applied to handle 12 in the counterclockwise direction (as viewed in FIG. 5A), the bottom side of compartment 18 pushes pawl teeth 54 against teeth 40 of gear ring 36. That is, the pawl remains wedged between the gear ring and the compartment's bottom edge, and the force applied from the operator's hand to the pawl through bottom side 88 of compartment 18 is applied in the counterclockwise direction to a work piece through gear ring 36.

Alternatively, if an operator applies torque to the handle in the clockwise direction (as viewed in FIG. 5C), gear ring teeth 40 apply a counterclockwise reaction force to pawl 52. If gear ring 36 remains rotationally fixed to the work piece and the reaction force is reversed, the pawl moves back and up into compartment 18, causing side 60 of recess 56 to push against nose 86 of spring 78. This pushes spring front wall 84 back toward lever 62 against the spring's outward bias so that pawl teeth 54 eventually ride over gear teeth 40. Spring 78 then once again pushes side 60 radially outward from bottom portion 66 so that pawl 52 moves back down wall 88 and into the next set of gear ring teeth. This ratcheting process repeats as the operator continues to rotate handle 12 in the clockwise direction.

Figure 5B:
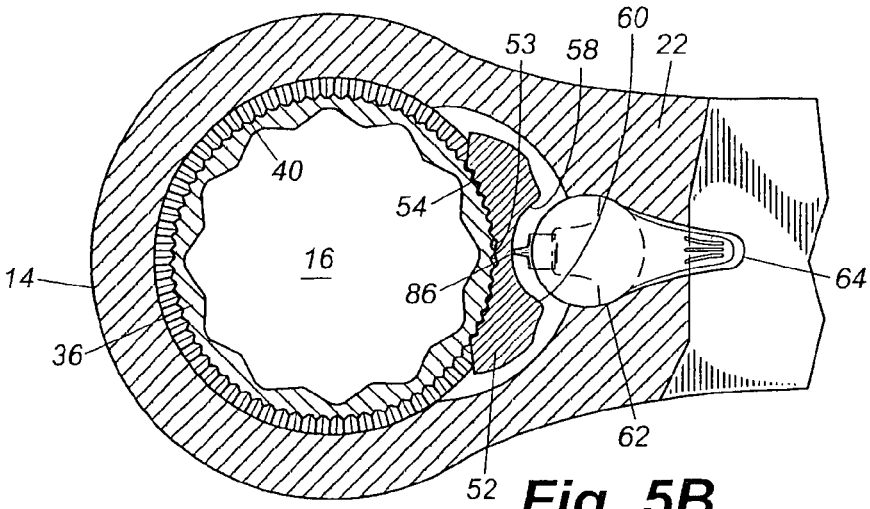
FIG. 5B is a partially cut-away top view of the ratcheting tool as in FIG. 1.
Figure 5C:
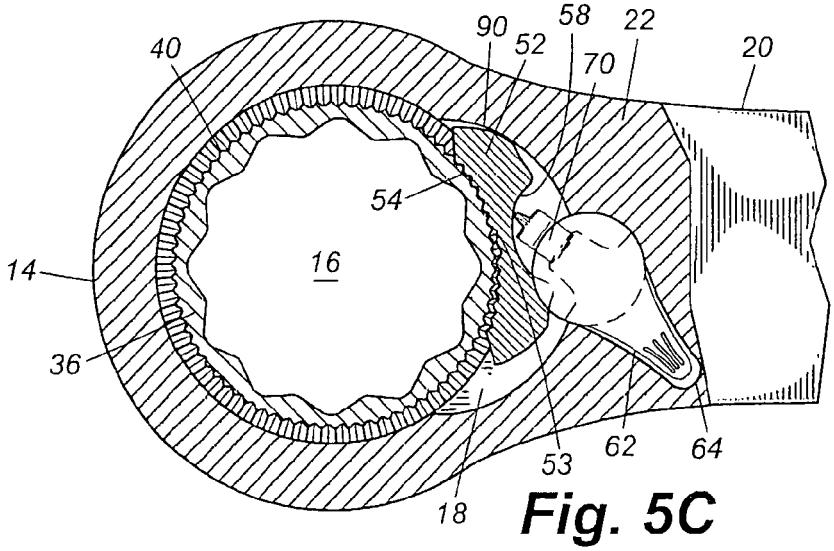
FIG. 5C is a partially cut-away top view of the ratcheting tool as in FIG. 1.

To change the operative direction of ratcheting tool 10, the operator rotates lever 62 in the clockwise direction (as viewed in FIG. 5B). Lever bottom portion 66 (FIG. 4) rotates in hole 26, and the spring moves clockwise in the pawl pocket through recess 56 (FIG. 2) toward side 58 (FIG. 5B). Initially, the pawl pivots slightly, and the load-bearing pawl teeth move away from the gear teeth. As the spring moves toward the apex of the recess, the pawl begins to shift up and back in compartment 18. The back wall of the pawl may define a ridge at the apex that separates the back recess into two recessed portions. However, in either case, further rotation of the lever brings the spring into contact with the apex of the recess, causing the pawl teeth to ride up and back into compartment 18 over the gear teeth. Gear ring 36 may also rotate slightly. In this position, pawl 52 moves the spring's front wall 84 back toward back wall 80 against the outward bias of the spring. As the operator continues to rotate lever 62, spring nose 86 moves against side 58 and applies a counterclockwise force to the pawl so that the pawl moves upward in compartment 18 and wedges between the gear ring and the compartment's top edge 90. In this position, the configuration and operation of the gear, the pawl, and the lever mirror the pawl's operation described above with respect to FIG. 5A. That is, the tool ratchets and applies torque to a work piece in the same manner but in the opposite direction.

Figure 6:
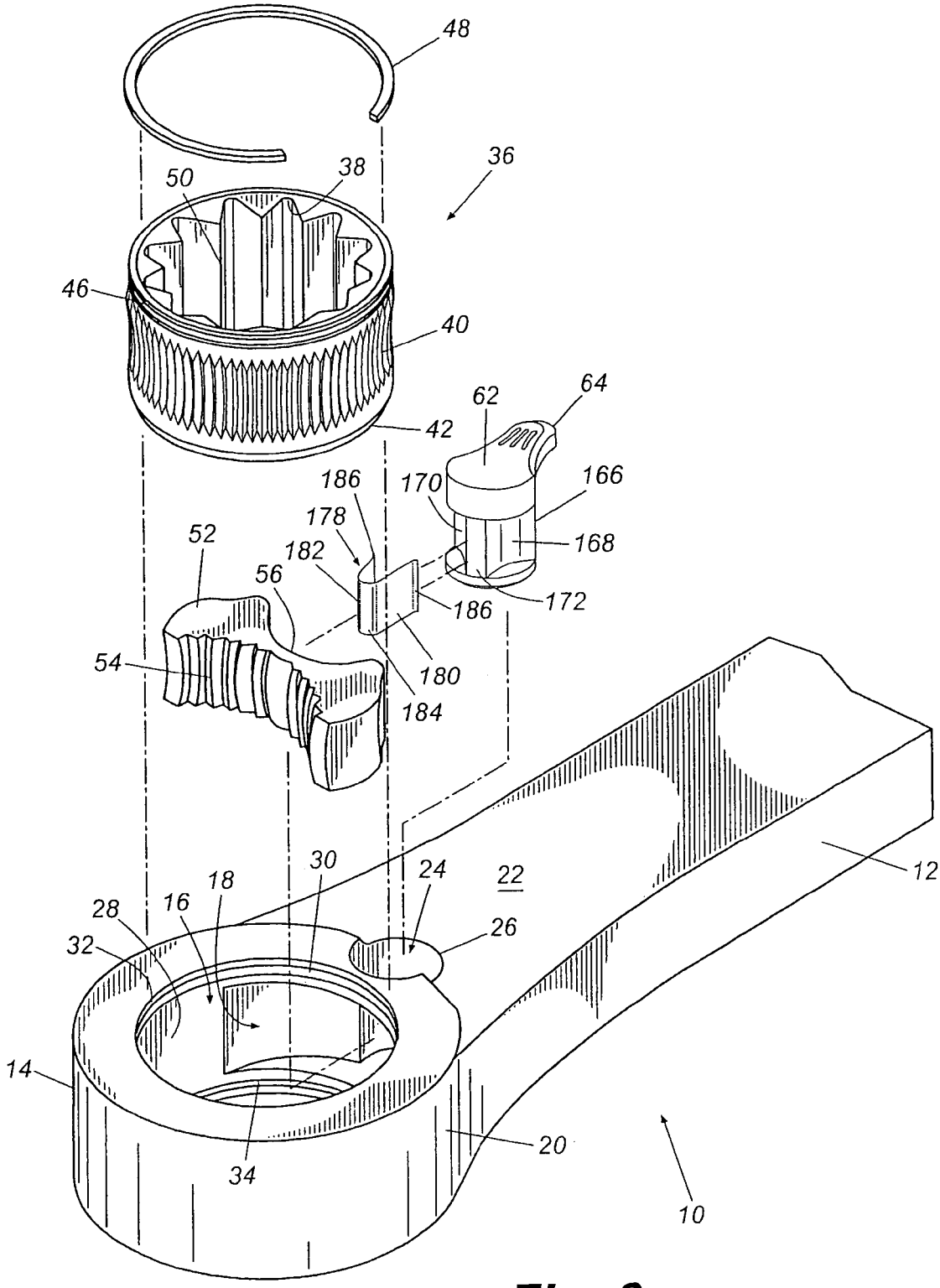
FIG. 6 is an exploded view of an embodiment of a ratcheting tool in accordance with an embodiment of the present invention.

FIG. 6 illustrates an embodiment having an alternate lever 62 and detent 78. A bottom portion 166 of lever 62 has a front face 172 and recessed contact areas 168 and 170. Detent 178 is a U-shaped spring having an arcuate front face 184, sidewalls 180 and 182 and curved ends 186. Spring 178 is made from stainless steel in a preferred embodiment but may be formed from any suitable resilient material including tool steel. In the spring's rest state, the gap between sidewalls 180 and 182 is less than the width of the lever's front face 172. Thus, sidewalls 180 and 182 spread apart from each other as the spring receives the front face of the lever's bottom portion, and the spring force applied by the spring's arcuate front face 184 biases sidewalls 180 and 182 toward each other against contact areas 168 and 170.

Because sidewalls 180 and 182 and curved ends 186 squeeze inward against the walls of contact areas 168 and 170, which flare outward toward the back of lever bottom portion 166, the sidewalls tend to push the spring forward on the lever away from the bottom portion's front face 172. Thus, the U-shaped spring's front face 184 exerts a force against the back of the pawl, biasing the pawl into contact with the gear ring.

Figure 7A:
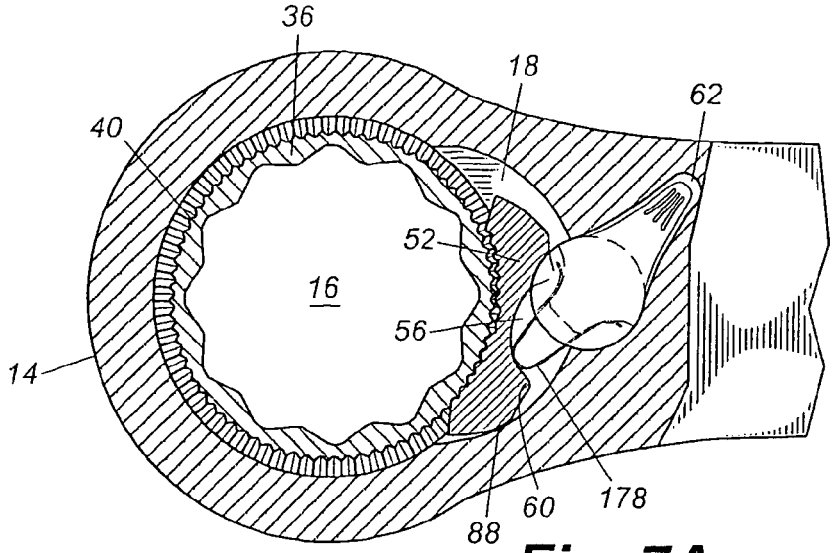
FIG. 7A is a partially cut-away top view of the ratcheting tool as in FIG. 6.

In operation, pawl 52 may slide to either side of compartment 18. In the position shown in FIG. 7A, lever 62 is rotated counterclockwise to wedge pawl 52 between gear ring 36 and bottom side 88 of compartment 18. Outwardly biased front face 184 of spring 178 engages side 60 of pawl 52 so that as the lever rotates, the front face pushes the pawl to a position at which teeth 54 on the bottom side of pawl 52 align with and engage gear teeth 40. The pawl end proximate wall 88 abuts the wall so that the pawl wedges between the wall and the gear. Thus, if torque is applied to handle 12 in the counterclockwise direction (as viewed in FIG. 7A), the bottom side of compartment 18 pushes pawl teeth 54 against teeth 40 of gear ring 36. That is, the pawl remains wedged between the gear ring and the compartment's bottom edge, and the force applied from the operator's hand to the pawl through bottom side 88 of compartment 18 is applied in the counterclockwise direction to a work piece through gear ring 36.

Alternatively, if an operator applies torque to the handle in the clockwise direction (as viewed in FIG. 7A), gear ring teeth 40 apply a counterclockwise reaction force to pawl 52.

If gear ring 36 remains rotationally fixed to the work piece, the pawl moves back and up into compartment 18, causing side 60 of recess 56 to push against front face 184 of spring 78. This pushes spring front wall 184 back toward lever 62 against the spring's outward bias so that pawl teeth 54 eventually ride over gear teeth 40. Spring 178 then once again pushes side 60 away from bottom portion 66 so that pawl 52 moves back down wall 88 and into the next set of gear ring teeth. This ratcheting process repeats as the operator continues to rotate handle 12 in the clockwise direction.

Figure 7B:
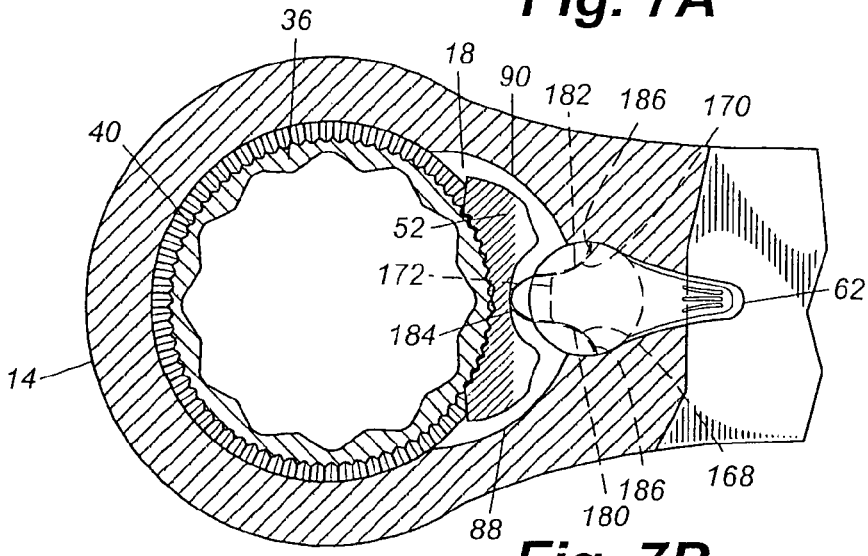
FIG. 7B is a partially cut-away top view of the ratcheting tool as in FIG. 6.
Figure 7C:
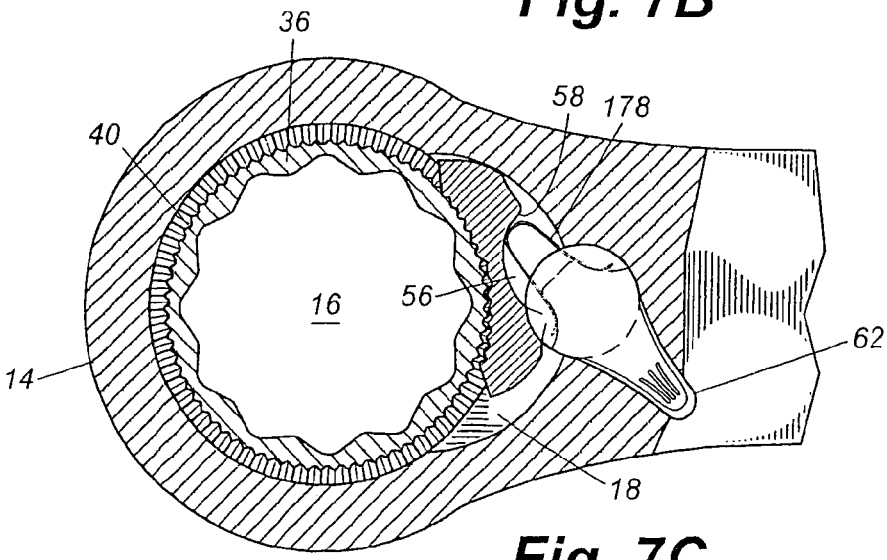
FIG. 7C is a partially cut-away top view of the ratcheting tool as in FIG. 6.

To change the operative direction of ratcheting tool 10, the operator rotates lever 62 in the clockwise direction (as viewed in FIG. 7B). Lever bottom portion 166 (FIG. 6) rotates in hole 26, and the spring moves clockwise in the pawl pocket through recess 56 (FIG. 6) toward side 58 (FIG. 7B). Initially, the pawl pivots slightly, and the load-bearing pawl teeth move away from the gear teeth. As the spring moves toward the apex of the recess, the pawl begins to shift up and back in compartment 18. Further rotation brings the spring into contact with the apex of the recess, causing the pawl teeth to ride up and back into compartment 18 over the gear teeth. Gear ring 36 may also rotate slightly. When lever 62 is in the neutral position (FIG. 7B), pawl 52 urges spring 178 back toward lever face 172, forcing curved ends 186 of walls 180 and 182 to move back along contact areas 168 and 170 so that the spring's front face 184 moves toward bottom portion front face 172. As the operator continues to rotate lever 62, spring front face 184 moves against side 58 and applies a counterclockwise force to the pawl so that the pawl moves upward in compartment 18 and wedges between the gear ring and the compartment's top edge 90 (FIG. 7C). In this position, the configuration and operation of the gear, the pawl, and the lever mirror the pawl's operation described above with respect to FIG. 7A. That is, the tool ratchets and applies torque to a work piece in the same manner but in the opposite direction.

Figure 8:
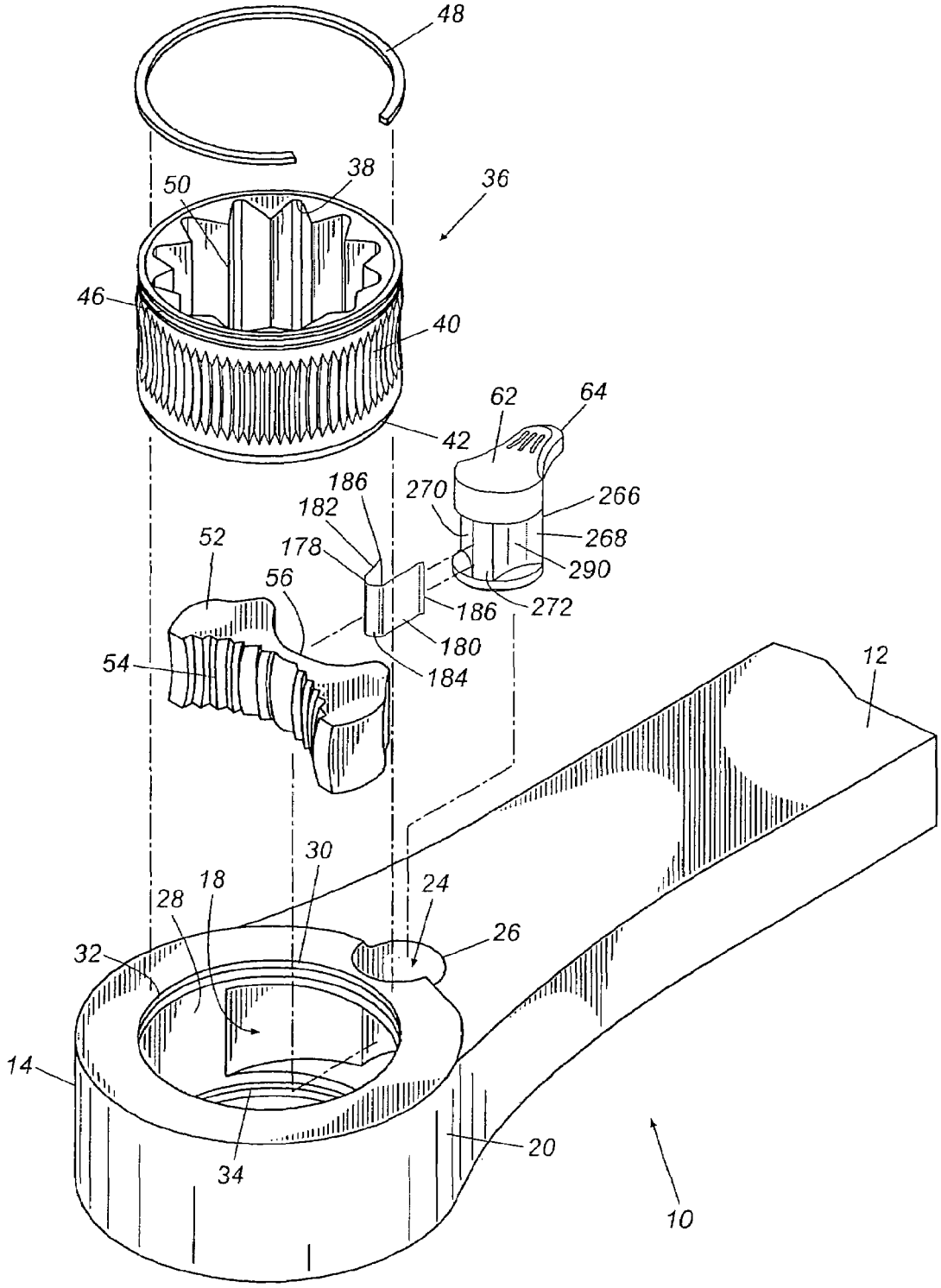
FIG. 8 is an exploded view of an embodiment of a ratcheting tool in accordance with an embodiment of the present invention.

In the embodiment shown in FIG. 8, the ratchet tool is generally the same as that shown in FIGS. 6 and 7A to 7C, except that bottom portion of lever 62 has been modified. In particular, bottom portion 266 has a front face 272 and recessed areas 268 and 270. Recessed areas 268 and 270 define flat contact areas 290, only one of which is shown in the figure. As previously described, the bottom portion receives U-shaped detent 178; however, in the current embodiment, curved ends 186 rest against the flat contact areas 290 of respective recessed areas 268 and 270, and sidewalls 180 and 182 are in contact with the walls of recessed areas 268 and 270. The operation of lever 62 and U-shaped detent 178 is identical to the prior embodiment except that curved ends 186 rest on and move along flat contact areas 290 instead of moving along a curved wall surface.

It should be understood that curved ends 186 may be curved inward to form a loop so that the end edge is proximate the inner surface of the spring, or alternatively, they may also be looped outward so that the end edges are proximate the outer surface of the spring. In either case, the size and shape of the loop and the curvature of contact areas 168 and 170 effect the amount of reward force necessary to move the spring toward lever front face 172 against the outward bias of the spring. Additionally, the size and shape of the looped curved ends also determines the ability of the spring to maintain its lateral orientation with respect to lever front face 172.

Figure 9:
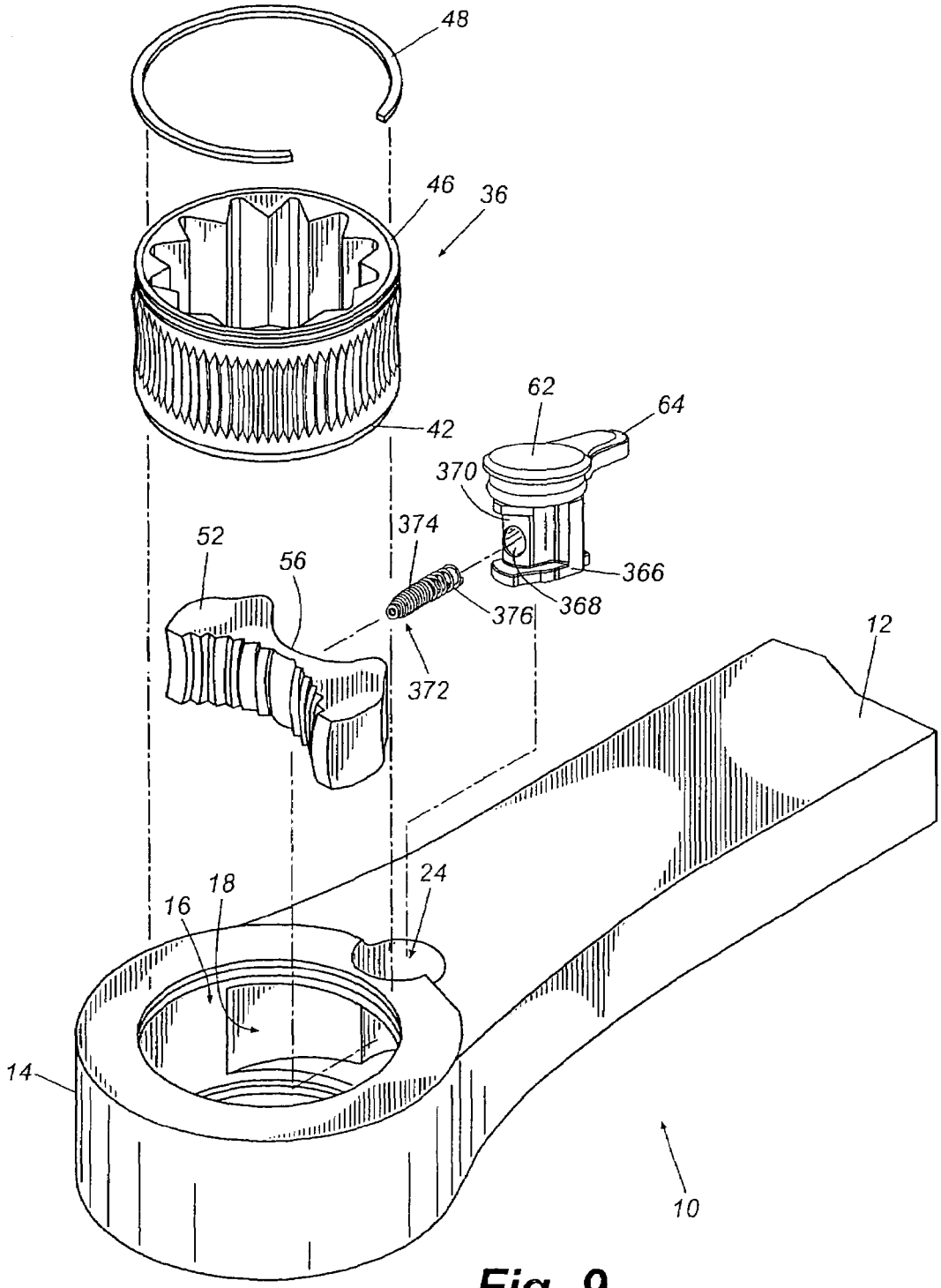
FIG. 9 is an exploded view of an embodiment of a ratcheting tool in accordance with an embodiment of the present invention.

In yet another embodiment, FIG. 9 illustrates a lever 62 having a handle 64 and a bottom portion 366. Bottom portion 366 defines a blind bore 368 in a front face 370. Blind bore 368 is sized and shaped to receive a detent 372. Detent 372 is a spring having a tightly wound spring portion 374 and a loosely wound spring portion 376 that biases the tightly wound portion outward of blind bore 368 into biasing contact with the walls of pawl recess 56. The detent can be formed from any suitable material that deforms and returns to its original shape, for example nylon, steel, or other suitable metal or polymer. In the preferred embodiment, detent 372 is formed from steel or other metallic material.

In operation, the pawl may slide to either side of the pawl compartment. In the position shown in FIG. 9A, lever 62 is rotated counterclockwise to wedge the pawl between the gear ring and a bottom side of the pawl compartment. Outwardly biased portion 374 of detent 372 engages the pawl recess so that as the lever rotates, the front face pushes the pawl to a position at which the pawl teeth on the bottom side of the pawl align with and engage the gear teeth. The pawl end proximate the bottom of the pawl pocket abuts the wall so that the pawl wedges between the wall and the gear. Thus, if torque is applied to the handle in the counterclockwise direction (as viewed in FIG. 9A), the bottom side of the pawl compartment pushes the pawl teeth against the gear teeth. That is, the pawl remains wedged between the gear ring and the compartment's bottom edge, and the force applied from the operator's hand to the pawl through the bottom side of compartment 18 is applied in the counterclockwise direction to a work piece through the gear ring.

Figure 9A:
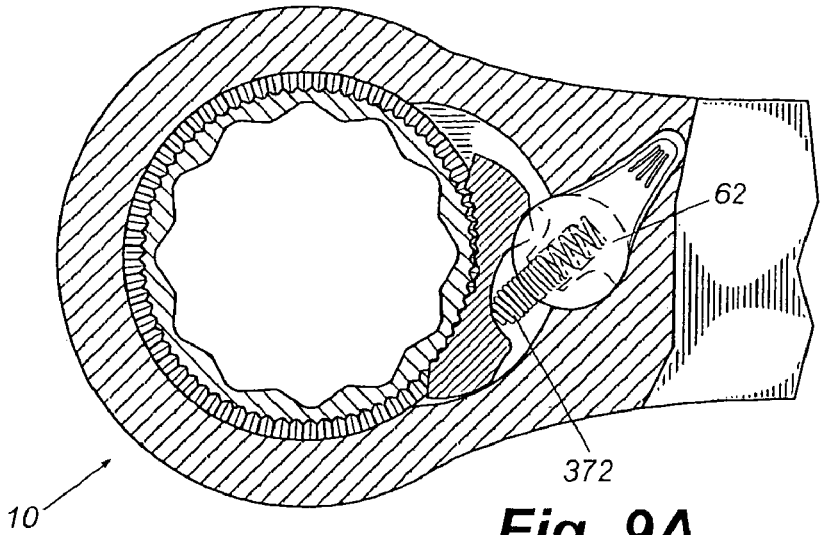
FIG. 9A is a partially cut-away top view of the ratcheting tool as in FIG. 9.
Figure 9B:
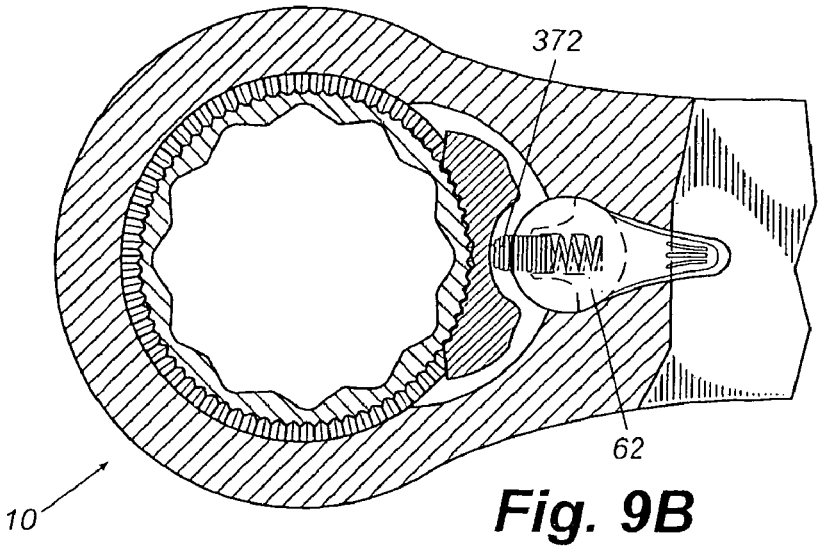
FIG. 9B is a partially cut-away top view of the ratcheting tool as in FIG. 9.
Figure 9C:
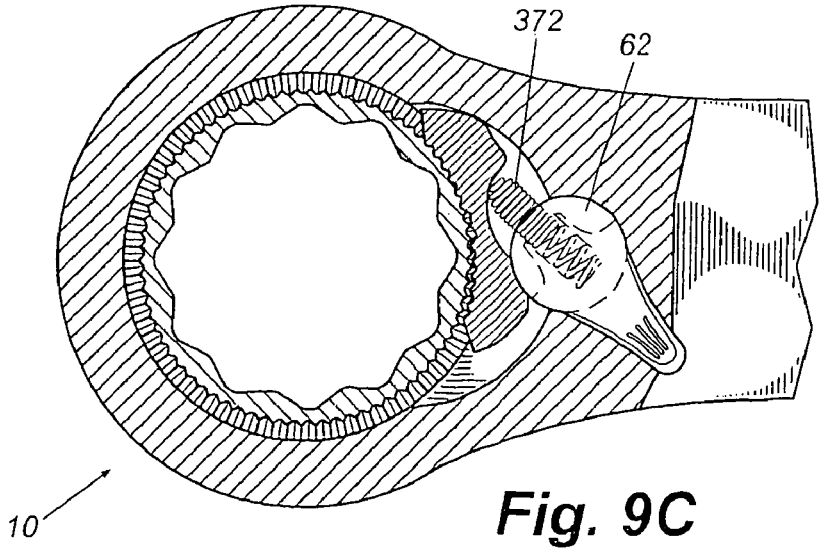
FIG. 9C is a partially cut-away top view of the ratcheting tool as in FIG. 9.

Alternatively, if an operator applies torque to the handle in the clockwise direction (as viewed in FIG. 9A), the gear ring teeth apply a counterclockwise reaction force to the pawl. If the gear ring remains rotationally fixed to the work piece, the pawl moves back and up into the pawl compartment, causing the recess to push against tightly wound spring portion 374. This pushes the tightly wound portion 374 back into blind bore 368 against the outward bias of the loosely wound portion 376 so that the loosely wound portion compresses to allow the pawl teeth to eventually ride over gear teeth 40. Detent 372 once again pushes the pawl radially outward from lever's bottom portion so that pawl moves back down the bottom wall of the pawl compartment and into the next set of gear ring teeth. This ratcheting process repeats as the operator continues to rotate the handle in the clockwise direction. As shown in FIGS. 9A to 9C, the operation of lever 62 and detent 372 in ratchet 10 is similar to that of the previously described embodiments. Thus, as lever 62 is rotated, detent 372 moves pawl 52 in the pawl compartment between the pawl's two operative positions.

Figure 9D:
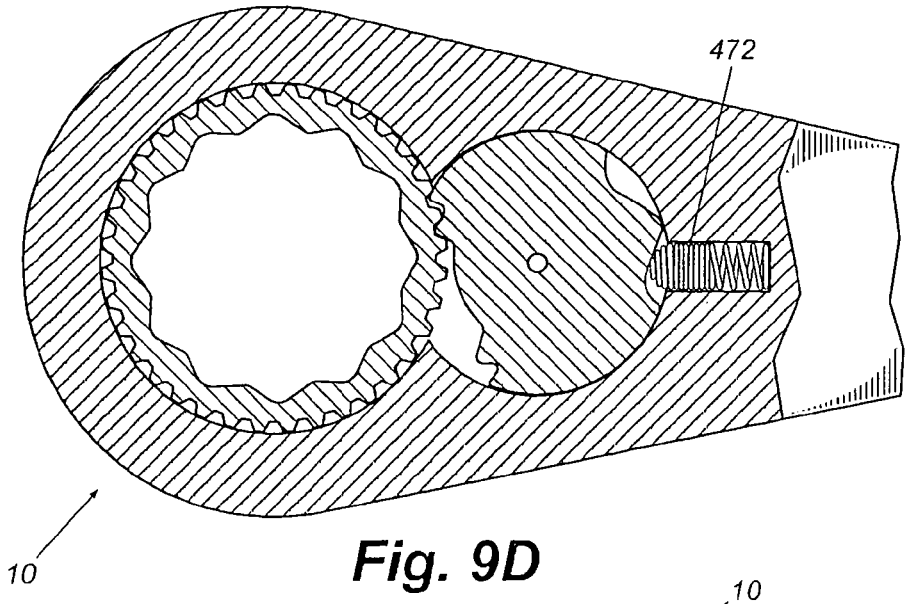
FIG. 9D is a partially cut-away top view of a ratcheting tool in accordance with another embodiment of the present invention, having a detent as shown in the ratcheting tool in FIG. 9.
Figure 9E:
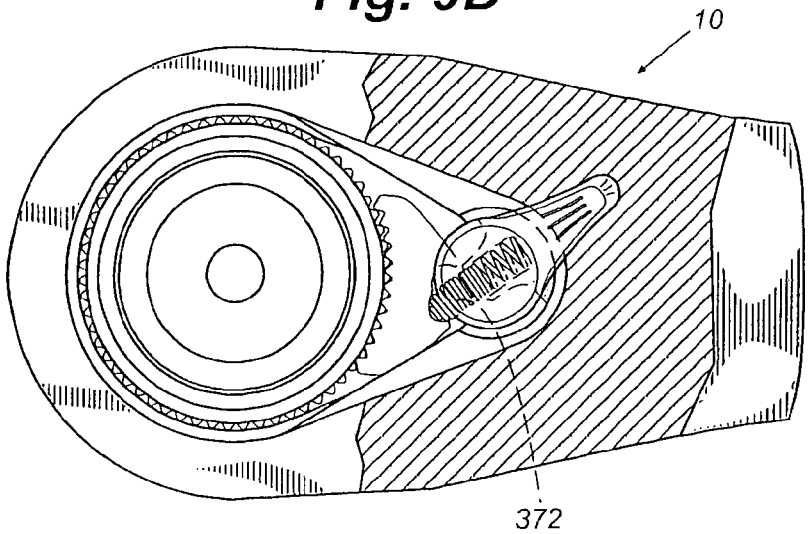
FIG. 9E is a partially cut-away view of a ratcheting tool containing a detent as shown in the ratcheting tool in FIG. 9.

As shown in FIGS. 9D and 9E, detent 372 may be used in other types of ratchet tools. For example, FIG. 9D shows the use of detent 372 in a ratcheting tool having a rotating pawl. The pawl is rotated using a hand actuatable knob (not shown) that allows the user to move the pawl between a first position (FIG. 9D), where the wrench applies torque in the counterclockwise direction, and a second position where the pawl is rotated to engage the second set of teeth with the gear teeth so that the wrench applies torque in the clockwise direction.

Figure 9F:
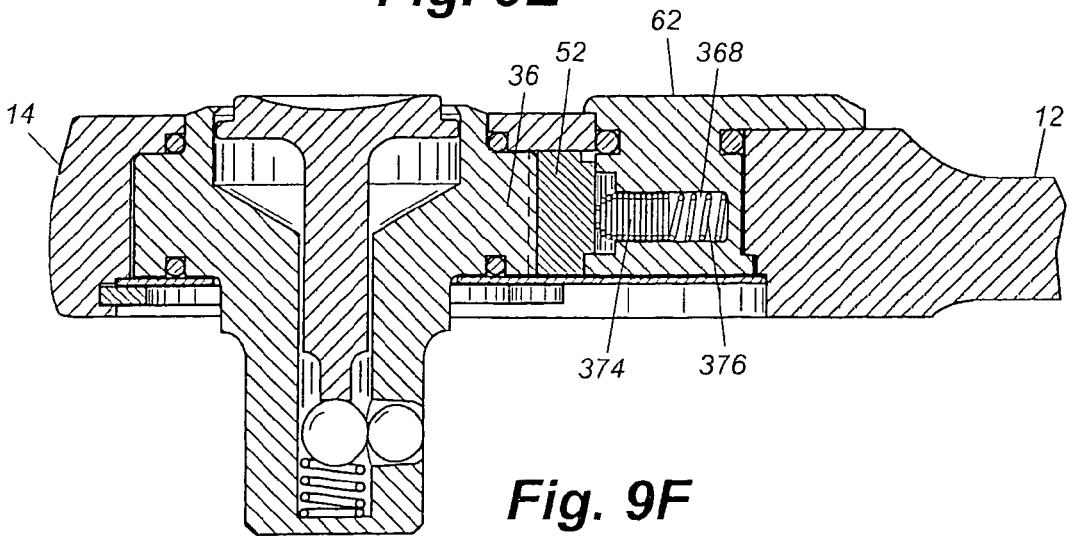
FIG. 9F is a side elevation view, in section, of the head of the ratcheting tool as in FIG. 9E.

FIGS. 9E and 9F show detent 372 used in a socket wrench. In general, as the pawl is rotated, detent 472 biases the pawl between the pawl's two operative positions. The detent operates by exerting force against the back face of pawl 52 as lever 62 is rotated. Because operation of the socket wrench is similar to the gear wrench, a discussion of the lever and pawl operation will not be repeated.

Figure 10:
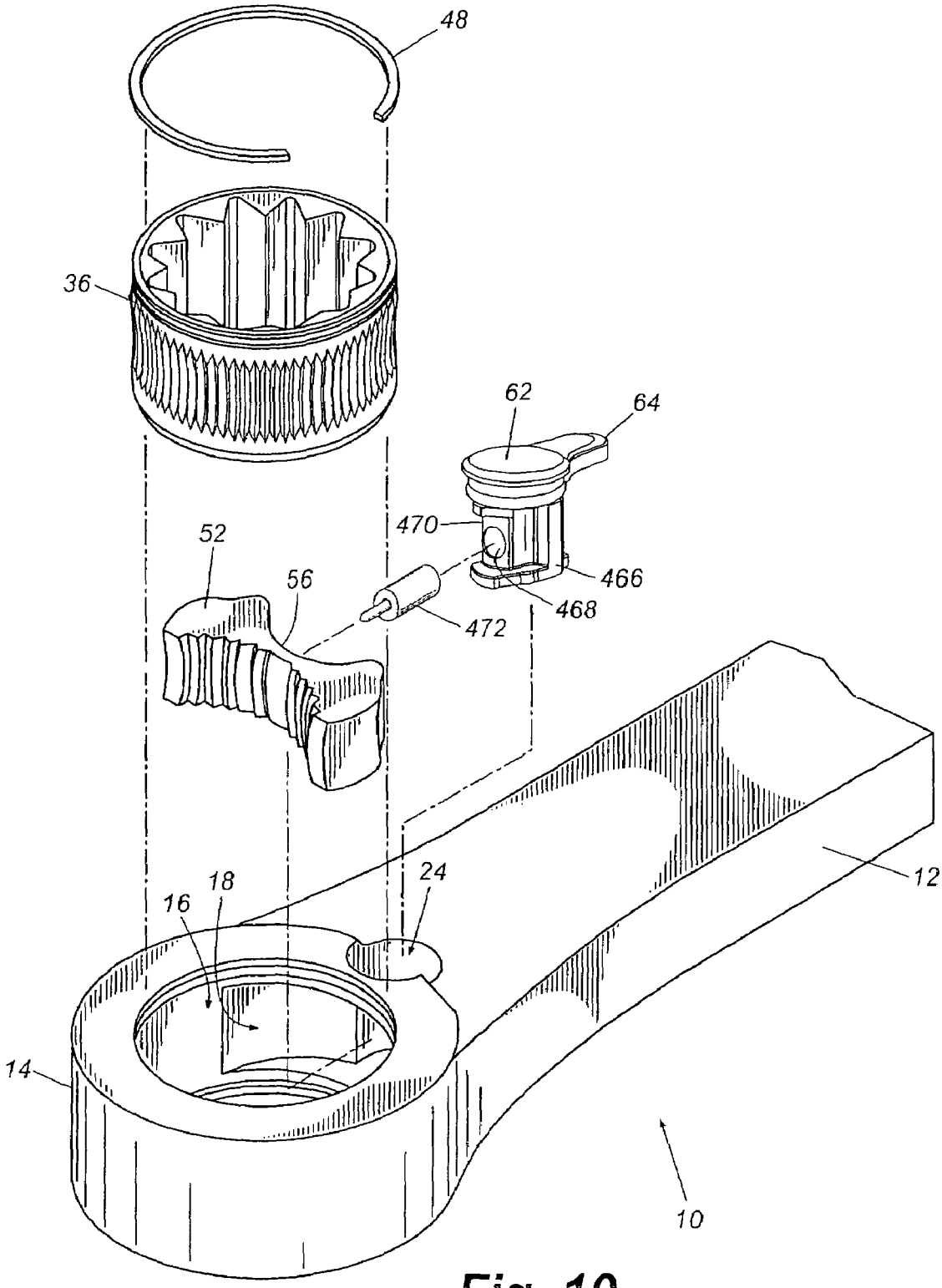
FIG. 10 is an exploded view of an embodiment of a ratcheting tool in accordance with an embodiment of the present invention.
Figure 10A:
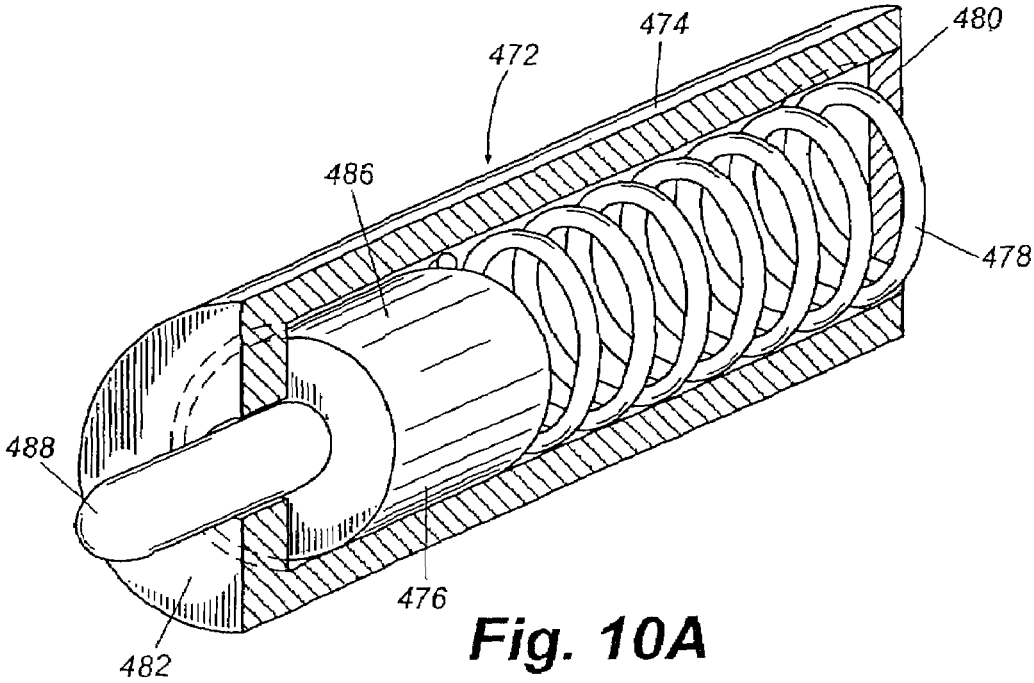
FIG. 10A is a cutaway view of a self-contained plunger used in the ratcheting tool in FIG. 10.
Figure 10B:
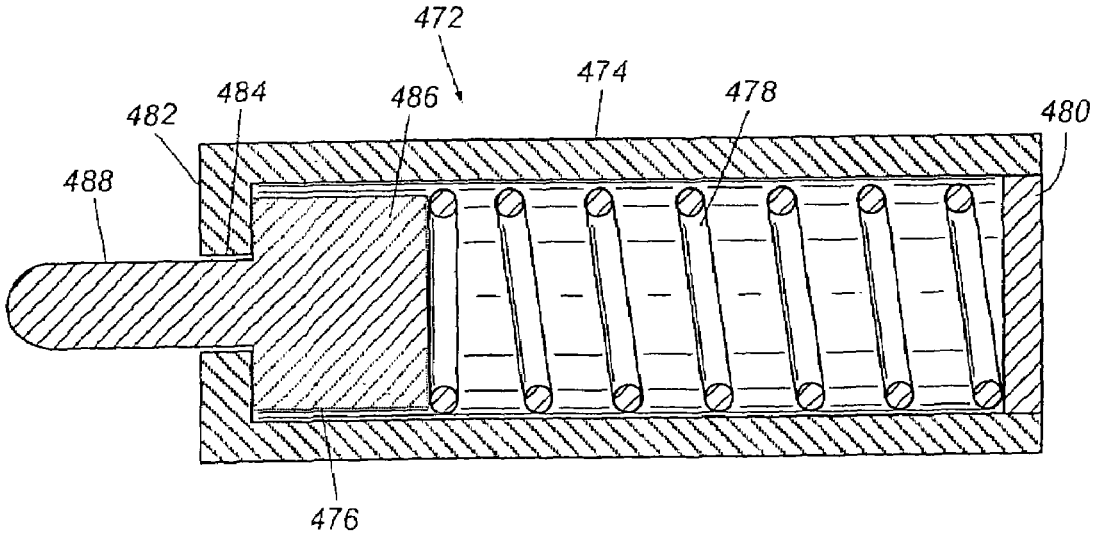
FIG. 10B is a sectional view of the self-contained plunger used in the ratcheting tool in FIG. 10.

In the embodiment shown in FIGS. 10–10B, lever 62 has a handle 64 and bottom portion 466. Bottom portion 466 defines a blind bore 468 in a face 470. Blind bore 468 is sized and shaped to receive a detent 472. As detailed in FIGS. 10A and 10B, detent 472 has a housing 474, a plunger 476, and a spring 478. Housing 474 is generally cylindrical in shape with a closed rear end 480 and a partially closed front end 482 that defines a hole 484. Housing 474 receives spring 478 and plunger 476 through the rear end of the housing so that the spring biases a portion of the plunger through hole 484. Once inserted into the housing, rear end 480 is secured in place by weldments, press fitting or other suitable attachment means. Plunger 476 has a base 486 in contact with spring 478 and a rod 488 that extends through hole 484.

Figure 10C:
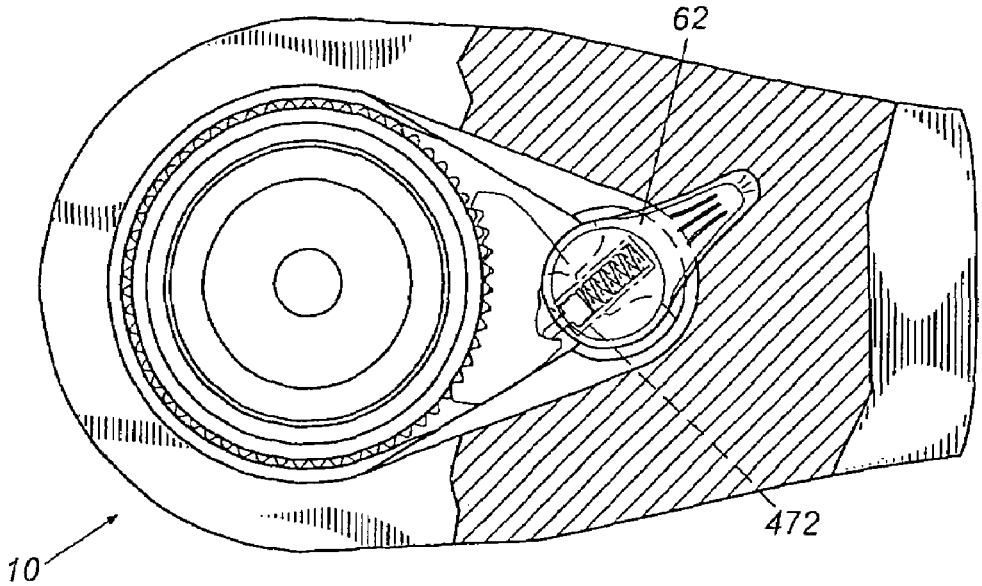
FIG. 10C is a top plan view of a ratcheting tool in accordance with another embodiment of the present invention, having a detent as shown in FIG. 10A.
Figure 10D:
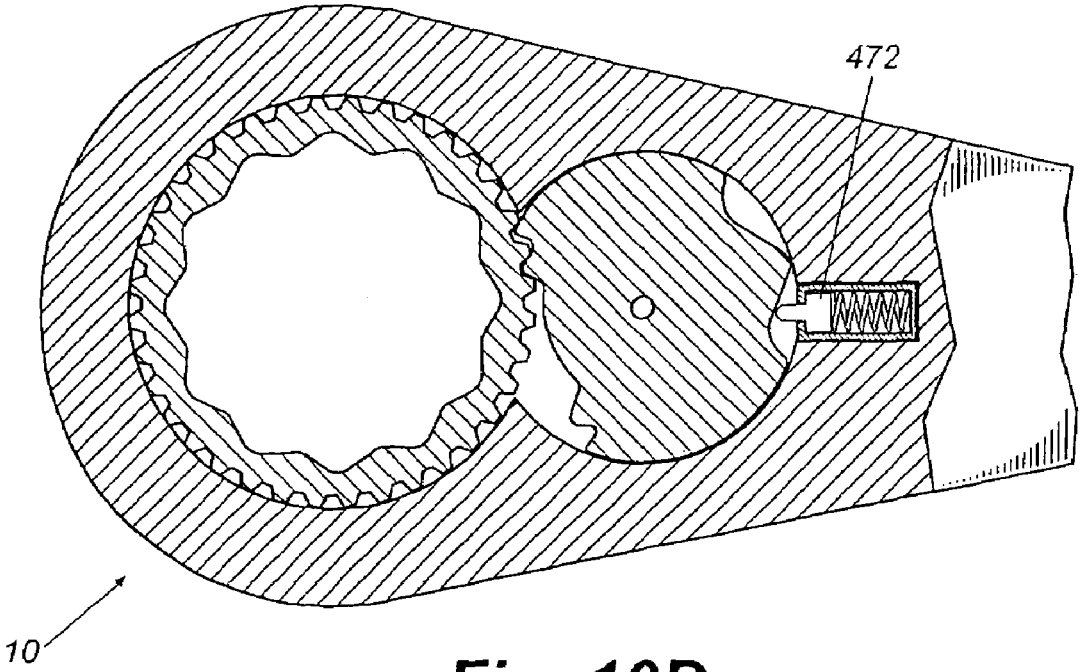
FIG. 10D is a top plan view of a ratcheting tool in accordance with another embodiment of the present invention, having a detent as shown in FIG. 10A.

Because operation of lever 62 and detent 472 is similar to that of the previously described sliding pawl embodiments, a discussion of the lever and pawl operation will therefore not be repeated. The detent can also be used in other ratchet tool constructions. For example, FIG. 10C shows detent 472 used in a socket wrench, and FIG. 10D shows pin unit 472 used in a ratcheting tool having a rotating pawl construction.

In any of the above-described embodiments using a sliding pawl, the detents to move the sliding pawl may be used in a ratcheting wrench in which the pawl has a radius that differs from the radius of the gear wheel. That is, the radius of the pawl face can be made slightly larger than the radius of the gear teeth allowing for a smoother operation of the gear and pawl.

Figure 11A:
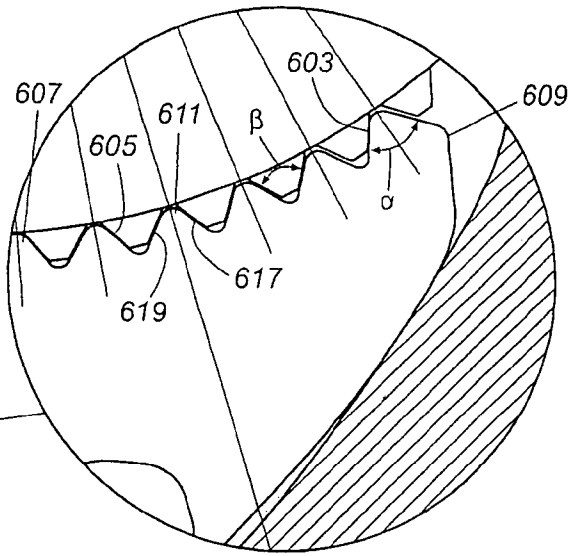
FIG. 11A is an enlarged view of a portion of the components shown in FIG. 11.
Figure 11B:
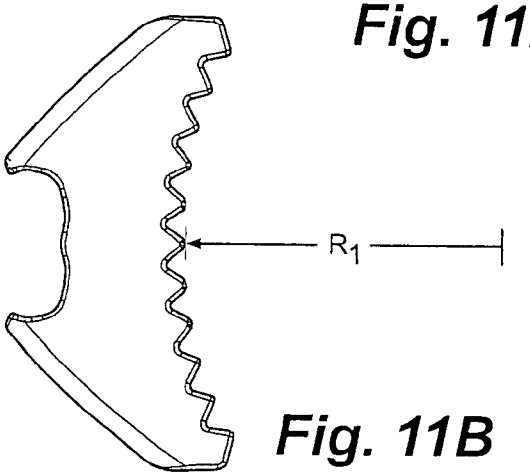
FIG. 11 is a top view of components of a wrench during a design procedure in accordance with an embodiment of the present invention.
Figure 11:
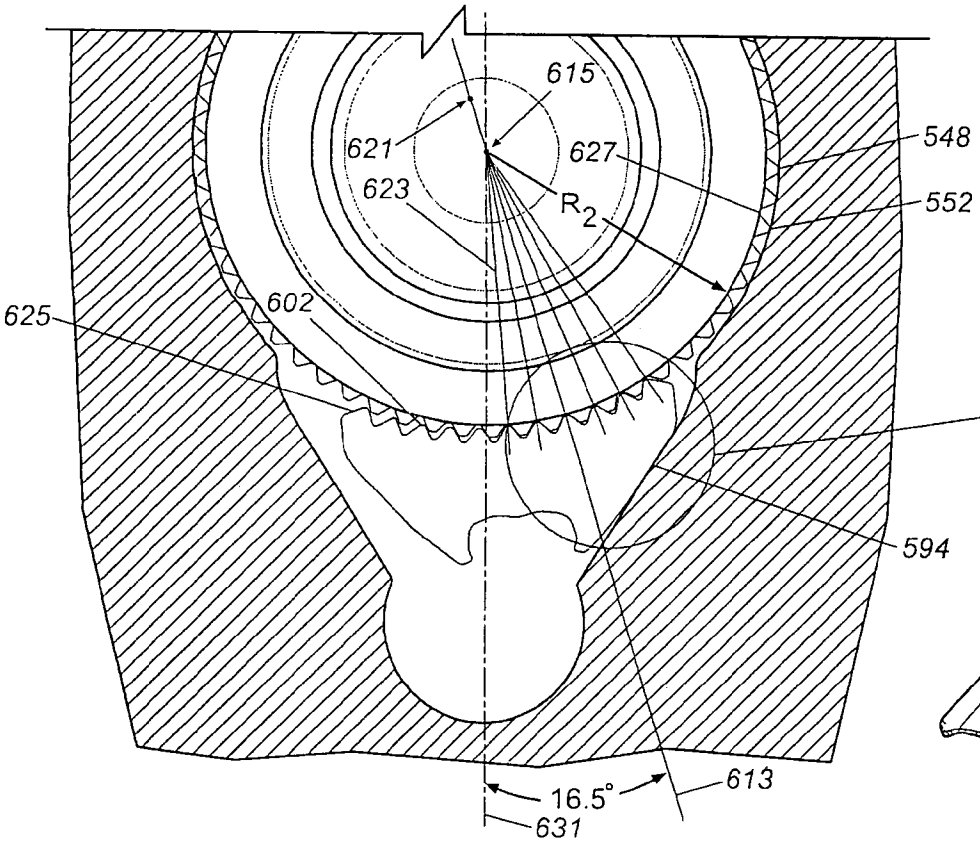

As shown in FIGS. 11, 11A and 11B, pawl 594 defines a plurality of vertically-aligned teeth 602 across the pawl's front face in an arc having a radius denoted by R1. In the illustrated embodiment, the tips of the teeth are rounded slightly, and radius R1 is measured to the rounded tips of the teeth. The radius R1 is different than a radius R2 (FIG. 11) between the center 615 of gear ring 548 and the troughs of its teeth 627. Because of manufacturing tolerances, the tips of the pawl teeth and the troughs of the gear teeth vary slightly in the radial direction, as should be understood in this art. Thus, radii R1 and R2 should be understood to lie within the pawl and gear tolerance ranges and are assumed to extend to the mid-points of the respective tolerance range for purposes of this discussion. Furthermore, it should be understood that radii R1 and R2 may be taken at other locations on the gear and the pawl, for example at the tips of the gear teeth and the troughs of the pawl teeth.

As indicated previously, radius R1 of a curve defined by the tips of the pawl teeth is larger than the radius R2 of a curve defined by the troughs of the gear teeth. The ratio of R1 to R2 is preferably within a range of 1:1.08 to 1:1.3. In the example shown in FIGS. 11–11B, the ratio is 1.0 to 1.12, where radius R1 equals 0.458 inches. The depth of the gear teeth and the pawl teeth is approximately 0.020 inches.

Preferably, the gear teeth are formed uniformly about the gear's circumference. The depth of each tooth, which may be defined as the distance along a radius of the gear extending between the tooth's tip and an arc connecting the troughs beside the teeth, is the same. The internal angle between the sides of a tooth (the "included" angle) is the same for each tooth, and the angle between sides of adjacent teeth (the "adjacent" angle) is the same for each pair of adjacent teeth.

The dimensions of the pawl teeth, and the ratio between gear radius R2 and pawl radius R1, may be determined by modifying an initial assumption that the pawl teeth will exactly fit the gear teeth. That is, the depths and the included and adjacent angles of the pawl teeth initially match the corresponding dimensions of the gear teeth. Still referring to FIGS. 11–11B, both sides of each pawl tooth are then pivoted (for example, using a computer-aided design ("CAD") system) toward each other by 1.5 degrees about the tooth's theoretical tip, thereby reducing the tooth's included angle by approximately 3 degrees. The non-loaded side 625 of each of the three outermost teeth on each side of the pawl is then shaved by 0.003–0.005 inches, and the tips of the teeth are rounded. The degree of rounding increases from the outermost teeth to the pawl center so that the rounded tips define a common radius (within manufacturing tolerances). As will be appreciated, this procedure results in a slightly non-flush engagement between the load-bearing sides 603 of the pawl teeth and the opposing gear tooth sides.

Because the pawl radius R1 is larger than the gear radius R2, the included angles $\alpha$ and adjacent angles $\beta$ of the pawl teeth are not uniform. The variation results from pivoting the pawl teeth's non-load-bearing sides 605 so that the included angle $\alpha$ of each tooth is reduced by a desired amount (preferably one to two degrees) less than the included angle of the gear teeth. This adjustment results in a slight gap between the non-load-bearing gear teeth sides and the non-load-bearing pawl teeth sides 605. The gap reduces or eliminates fluid adhesion (caused by grease or oil in the mechanism) and taper fit between the gear and pawl teeth, thereby facilitating smooth removal of the pawl teeth from the gear teeth during ratcheting and pawl reversal. FIG. 11A illustrates the pawl teeth to one side of a center tooth 607. The positions of the teeth on the opposite side of tooth 607 are a mirror image of the illustrated side and are therefore not shown.

It should be understood that a ratio of the gear diameter can be used to scale the dimensions of the pawl, reversing lever, ratchet head, and other ratchet components. The gear diameter for determining the ratio is measured across the tips of the gear teeth. When determining the ratio of the pawl radius to the gear radius, radius R1 is measured to the tips of the pawl teeth and R2 is measured to the troughs of the gear teeth as shown in FIG. 11.

The gear/pawl radius ratio may vary among tools of different sizes, but the ratio may also vary among tools of the same size. That is, the particular ratio for a given tool may be selected independently of other tool designs, preferably within a range of 1:1.08 to 1:1.3. A ratio for a particular tool design may be determined by trial and error, but it is believed that the two primary factors determining an appropriate range for the radius ratio are (1) the gear radius and (2) the depth of the teeth on the gear and the pawl. Once these parameters are chosen, a radius ratio may be selected on a CAD system or other graphic means through an alternate method described below.

FIGS. 11 and 11A represent a CAD depiction of gear 548 and pawl 594. The operation of CAD systems should be well understood in this art and is therefore not discussed herein. Initially, the pawl and gear are disposed so that they face one another. The body of the ratchet wrench head is illustrated for purposes of context but is preferably omitted from the CAD drawing. The theoretical (i.e. non-rounded) tip of each pawl tooth lies on a respective line 623 that passes through center 615 of gear 548 and the trough between the opposing gear teeth on the loaded side of the pawl. The included angles $\alpha$ are consistent across all pawl teeth and are the same as the gear teeth adjacent angles. The depth of the pawl teeth is the same as the depth of the gear teeth, and all teeth are as yet not rounded. An initial gear/pawl radius ratio is selected arbitrarily. The adjacent angle $\beta$ depends on the selected initial radius ratio but is the same for all pawl teeth. If a 1:1 ratio is selected, the pawl's adjacent tooth angle $\beta$ is the same as the adjacent angle between the gear teeth.

Next, a pivot tooth is selected on one side of the pawl's center tooth. Preferably, the pivot tooth is the principal load-bearing tooth. The particular number of load-bearing teeth on either pawl side depends on the density of teeth on the pawl, the design of the back of the pawl and the design of the compartment wall against which the pawl sits. Given a design where these factors are known, the load-bearing teeth may be identified by applying very high loads to a ratchet and observing which teeth are first to shear or by simply assessing the design from experience with prior designs. In the embodiment shown in FIGS. 11 and 11A, the load-bearing teeth are the four outermost teeth inward of pawl end 609, and the pivot tooth is preferably tooth 611—the closest one of these teeth to center tooth 607.

After selecting the pivot tooth, the pawl is moved so that pivot tooth 611 is received in exact alignment with the gap between adjacent teeth 617 and 619 on the gear. That is, tooth 611 is fully received in the gap between teeth 617 and 619, and its sides 603 and 605 are flush against the opposing sides of teeth 617 and 619, respectively. If the initial radius ratio is not 1:1, the pivot tooth is the only tooth that fits exactly between its opposing gear teeth. The teeth on either side of the pivot tooth are increasingly misaligned with the gaps between their opposing gear teeth.

The final pawl radius is defined along a radius line 613 that includes center 615 of gear 548 and the non-rounded tip of the pivot tooth. A point 621 on line 613 is initially defined as the center of curvature of the non-rounded tips of the pawl teeth as originally drawn on the CAD system. That is, point 621 is the origin of the pawl radius, and the pivot tooth defines the point at which an arc defined by the gear radius is tangent to an arc defined by the pawl radius. To determine the final pawl radius (in this instance, the radius to the theoretical tips of the pawl teeth), point 621 is moved along line 613 behind point 615. The adjacent angles β between the pawl teeth change in accordance with the changing pawl radius. The pawl teeth depth and included angles, as well as the alignment of the pivot tooth in the gap between its opposing gear teeth, remain fixed. As point 621 moves closer to gear center point 615 along line 613, the pawl radius decreases, and the pawl teeth on either side of the pivot tooth move closer into the gaps between the opposing gear teeth. Conversely, the pawl radius increases as point 621 moves away from center point 615, and the pawl teeth on either side of the pivot tooth move away from the gear teeth. Preferably, point 621 is selected so that the non-rounded tip of the outermost tooth 625 (FIG. 11) on the opposite side of center tooth 607 from the pivot tooth is within one-half to fully out of the gap between its opposing gear teeth. That is, assume that an arc defined by troughs 627 between the gear teeth is assigned a value of zero and that an arc defined by the gear tooth tips is assigned a value of 1. The tip of pawl tooth 625 preferably is disposed within a range including and between two intermediate arcs located at 0.50 and 1.0.

Once the pawl radius, and therefore the gear/pawl radius ratio, has been determined, the pawl teeth are modified to their operative dimensions. The pawl remains located by the CAD system in the wedged position against the gear as shown in FIG. 11, and the pivot tooth remains in exact alignment with its opposing gear teeth. The non-loaded side 605 of each tooth, including the pivot tooth, is pivoted about the tip of the tooth so that the tooth's included angle is preferably one to two degrees less than the adjacent angle of the gear teeth. The side of the center tooth facing the loaded pawl teeth is adjusted in this step as a non-loaded side. The load-bearing sides 603 are not adjusted. Thus, except for the pivot tooth, the load-bearing sides of the pawl teeth are slightly out of flush with their opposing gear tooth sides.

This defines the dimensions of the gear teeth on one side of the pawl. The teeth on the other pawl side are then adjusted to be the mirror image (across the pawl's center line) of the first side. The pawl (and gear) teeth are rounded as desired, and the rounded tips preferably remain on a common arc.

At this point, the pawl tooth design is complete, and a pawl with the selected dimensions may be operated in a tool as shown in FIGS. 2, 6, 8, 9, 9E, 10 and 10C. In particular, the selection of the pawl radius so that the tip of the outermost non-loaded tooth is one-half to fully out of the gear teeth generally assures that when one side of the pawl or the other is wedged in the pawl compartment in engagement with the gear, only the teeth on that side are loaded against the gear teeth. The teeth on the trailing side remain unloaded.

Referring once again to FIGS. 2, 6, 8, 9 and 10, the gear and pawl teeth do not extend straight from the top to the bottom of the gear and pawl. That is, the gear's outer surface is concave, and the gear teeth extend vertically between the top and bottom of the gear in an inward curve. Correspondingly, the figures illustrate the gear teeth curving outward toward the gear's top and bottom edges. In this configuration, the pawl face is formed in a correspondingly convex shape so that the pawl teeth extend between the top and bottom of the pawl in an outward curve to interengage with the gear teeth.

Figure 12:
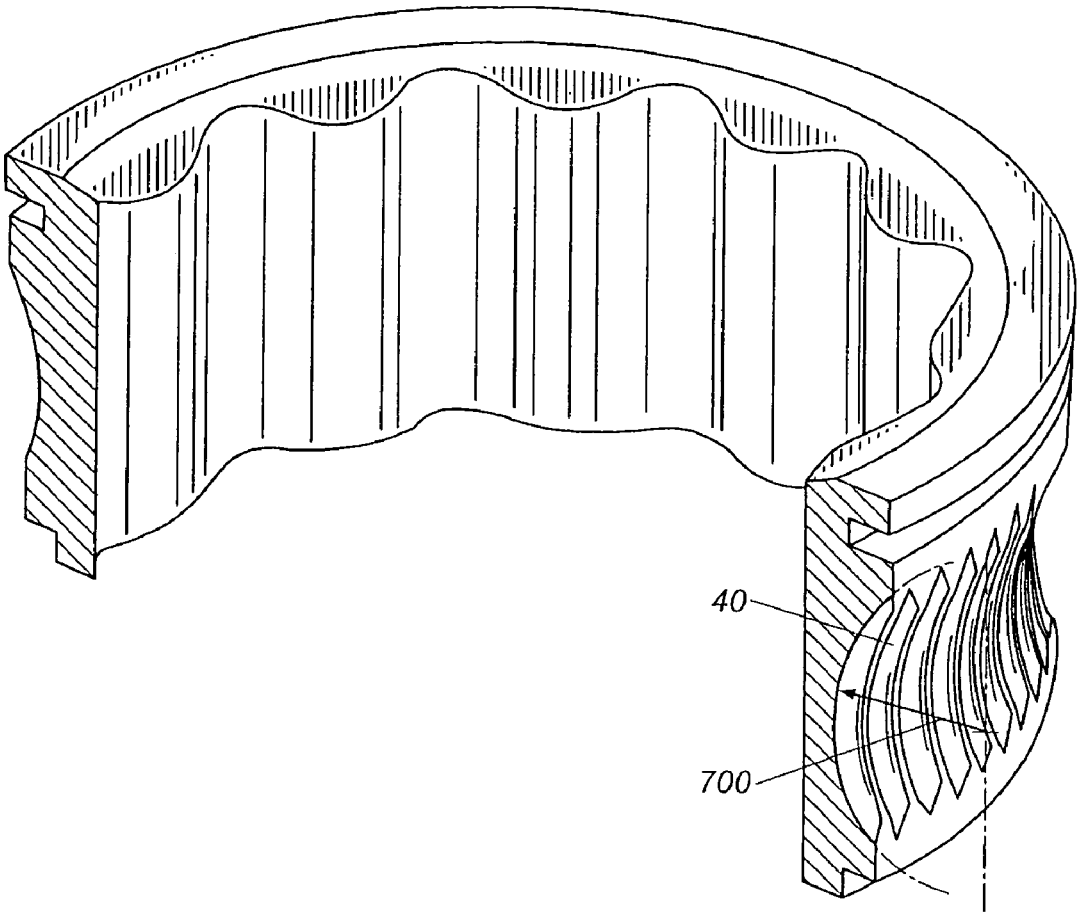
FIG. 12 is a partial perspective view of a gear ring in accordance with an embodiment of the present invention.
Figure 12A:
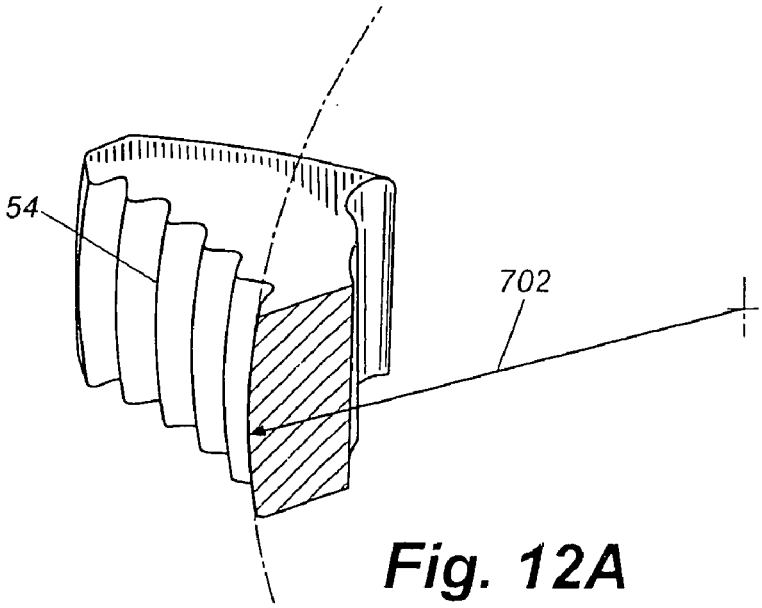
FIG. 12A is a partial perspective view of a pawl in accordance with an embodiment of the present invention.

Referring particularly to FIGS. 12 and 12A, a radius 700 of the arc extending between opposite axial edges of the gear and defined by the troughs between concave vertical gear teeth 40 may be equal to a radius 702 of the arc extending between top and bottom sides of the pawl face and defined by the edges of convex vertical pawl teeth 54. However, to allow for the effects of manufacturing tolerances in the alignment of the vertical teeth on the gear and the pawl, and of twisting deformation of the gear under high torque loads, the pawl's convex radius 702 is preferably less than the gear's concave radius 700. In an embodiment of a three-quarter inch ratchet wrench, for example, concave gear radius 700 is 0.236 inches, while convex pawl radius 702 is 0.200 inches. This arrangement permits effective operation of the wrench even if the gear and/or pawl teeth are as much as 0.020 inches out of vertical alignment. It should be understood that such a mismatch between the concave vertical gear radius and the convex vertical pawl radius may be practiced regardless of the relationship between the circumferential radii of the gear teeth and the pawl teeth. That is, the concave and convex radii may be different regardless whether the radius defined by an arc connecting the troughs of the gear teeth is equal to or different from the radius defined by an arc connecting the tips of the pawl teeth.

Additionally, it should be understood that the concave and convex radii of the gear and the pawl, respectively, may be defined at any suitable position on the gear and the pawl that oppose each other when the pawl teeth engage the gear teeth. Thus, for example, the concave gear radius may be defined at the edge of the gear teeth while the convex pawl radius may be defined at the troughs between the pawl teeth.

Furthermore, the construction of the ratcheting tool may affect the extent or the desirability of a mismatch between the concave and convex radii of the gear and the pawl. For example, a gear in a tool as shown in FIG. 2, in which the gear is retained from the top by a ring, may be subject to greater misalignment than a gear retained from the top by the tool head itself because the latter construction exerts greater resistance against forces in the upward direction typically applied through the gear when the tool is in use and provides smaller deviations from manufacturing tolerances. Accordingly, while a mismatch between the profile radii of the gear and the pawl may be employed in either arrangement, it is particularly desirable in a construction in which the gear is retained from the top by a retainer other than the wrench body, such as in the embodiment shown in FIG. 2.

As discussed above, the definition of a ratio between the gear radius and the pawl radius that is less than 1:1 (i.e., the gear radius is less than the pawl radius) facilitates the pawl's removal from the gear when the pawl transitions from one side of the pawl compartment to the other.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed:

1. A ratcheting tool comprising:

a. a body;

b. a gear rotatably disposed in said body and defining a first plurality of teeth about an outer circumference thereof;

c. a pawl disposed in said body and having a front side that faces said first plurality of gear teeth and that has a second plurality of teeth, and a back side facing away from said gear, wherein said pawl is movable between a first position in which said body imparts rotation to said gear in a first direction and a second position in which said body imparts rotation to said gear in a second direction opposite said first direction;

d. a lever rotatably disposed in said body proximate said pawl; and e. a detent disposed in a blind bore in one of said body and said lever and in operative engagement with said pawl, said detent having a housing with a first end and an inwardly pointing shoulder formed at an opposite second end, a plunger received in said housing such that an end of said plunger is retained in said housing by said inwardly pointing shoulder, and a spring that biases said plunger toward said pawl backside.

2. A ratcheting tool comprising, a. a body;

b. a gear rotatably disposed in said body and defining a first plurality of teeth about an outer circumference thereof;

c. a pawl disposed in said body and having a front side that faces said first plurality of gear teeth and that has a second plurality of teeth, and a back side facing away from said gear, wherein said pawl is movable between a first position in which said body imparts rotation to said gear in a first direction and a second position in which said body imparts rotation to said gear in a second direction opposite said first direction;

d. a lever rotatably disposed in said body proximate said pawl; and e. a detent disposed in a blind bore in one of said body and said lever and in operative engagement with said pawl, said detent having a housing, a plunger received in said housing and a spring that biases said plunger toward said pawl backside, wherein said housing defines a closed first end and a partially open second end.

3. The ratcheting tool of claim 1, wherein said pawl defines a first radius and wherein said gear defines a second radius that is smaller than said first radius.

4. The ratcheting tool of claim 1, wherein said housing first end is closed.

* * * * *

UNITED STATES PATENT AND TRADEMARK OFFICE

CERTIFICATE OF CORRECTION

PATENT NO. : 6,971,287 B2
APPLICATION NO. : 11/038651
DATED : December 6, 2005
INVENTOR(S) : Pei Y. Lee et al.

It is certified that error appears in the above-identified patent and that said Letters Patent is hereby corrected as shown below:

In claim 3, column 14, lines 34-36, please delete "wherein said pawl defines a first radius and wherein said gear defines a second radius that is smaller than said first radius." and replace with --wherein said second plurality of teeth are defined about a second radius and wherein said first plurality of teeth are defined about a first radius that is smaller than said second radius.--

Signed and Sealed this

Twenty-eighth Day of April, 2009

John Doll

JOHN DOLL
*Acting Director of the United States Patent and Trademark Office*